United States Patent [19]

Noguchi et al.

[11] 4,089,310

[45] May 16, 1978

[54] INTERNAL COMBUSTION ENGINE PROVIDING IMPROVED EXHAUST-GAS PURIFICATION

[75] Inventors: Masaaki Noguchi, Nagoya; Masaharu Sumiyoshi, Toyota; Yukiyasu Tanaka, Okazaki; Taro Tanaka, Chiryu, all of Japan

[73] Assignee: Nippon Soken, Inc., Nishio, Japan

[21] Appl. No.: 674,876

[22] Filed: Apr. 8, 1976

[30] Foreign Application Priority Data

Apr. 17, 1975 Japan ..... 50-46687
Jul. 10, 1975 Japan ..... 50-84962

[51] Int. Cl.[2] ..... F02M 7/00; F02B 3/00

[52] U.S. Cl. ..... 123/119 LR; 60/276; 60/285; 123/32 EC

[58] Field of Search ..... 123/119 EC, 32 EC, 32 EA, 123/127; 60/276, 285

[56] References Cited

U.S. PATENT DOCUMENTS

| | | | |
|---|---|---|---|
| 3,827,237 | 8/1974 | Linder | 123/32 EA |
| 3,910,240 | 10/1975 | Omori et al. | 123/119 LR |
| 3,982,393 | 9/1976 | Masaki | 123/119 LR |
| 4,000,614 | 1/1977 | Abthoff | 123/119 LR |
| 4,051,816 | 10/1977 | Masaki | 123/119 LR |

*Primary Examiner*—Ronald B. Cox
*Attorney, Agent, or Firm*—Cushman, Darby & Cushman

[57] ABSTRACT

In an internal combustion engine having a plurality of sequentially operative combustion chambers, harmful components in exhaust gases are reduced. At least one of the combustion chambers is supplied with a rich mixture having a smaller air-to-fuel ratio than the stoichiometric air-to-fuel ratio and the remaining combustion chambers are fed with a lean mixture whose air-to-fuel ratio is greater than the stoichiometric air-to-fuel ratio. At the point where the exhaust gases emitted from the combustion chambers gather, the total air-to-fuel ratio of the rich and lean mixtures is detected producing a signal representing the total air-to-fuel ratio. One of the rich and lean mixtures is controlled in accordance with the air/fuel ratio signal to maintain the total air-to-fuel ratio practically at a predetermined value.

14 Claims, 14 Drawing Figures

INTERNAL COMBUSTION ENGINE PROVIDING IMPROVED EXHAUST-GAS PURIFICATION

The present invention relates to an internal combustion engine providing improved exhaust-gas purification.

As is well known, the pollution of the air by the exhaust gases has recently become a serious social problem as a result of the rapid increase of internal combustion engines, particularly automobiles. While many different exhaust emission control devices have been proposed to solve the problem of air pollution, these devices involve many difficult problems since the devices are disadvantageous in respect of manufacturing costs, exhaust emission controlling efficiency, dimension, etc.

Figure 1:
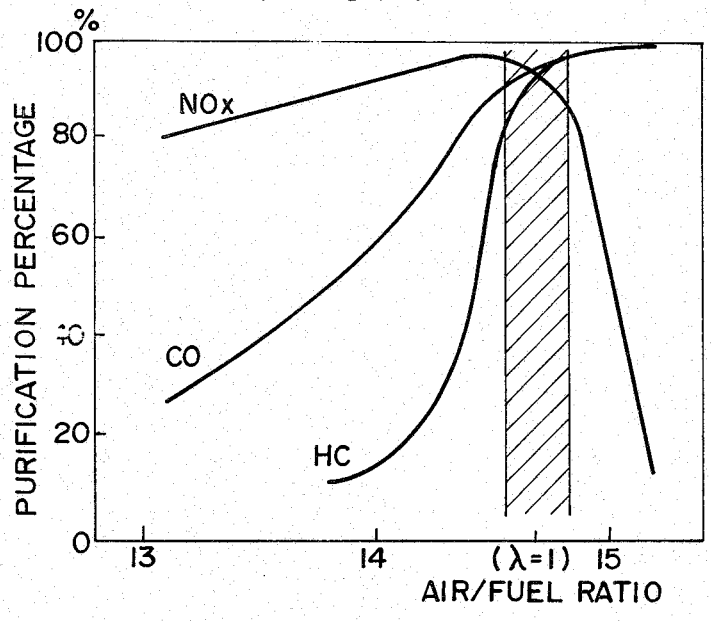
FIG. 1 is a characteristic diagram showing the exhaust harmful component purification percentage curves of a three-component catalyst.

As an example of these conventional devices, the three-component catalytic system of the type having the performance characteristics shown in FIG. 1 has been studied extensively.

This system can effectively perform the required oxidation and reduction functions when the mixtures fed to the engine fall within a narrow range of air-to-fuel ratios near the stoichiometric air-to-fuel ratio (i.e., the hatched portion in FIG. 1) and therefore an air/fuel ratio sensor is inserted in the exhaust pipe to effect the feedback control of the air-to-fuel ratio of the mixtures in accordance with the output signal of the air/fuel ratio sensor to thereby bring the air-to-fuel ratio of the mixtures fed to the engine within the hatched range.

Figure 2:
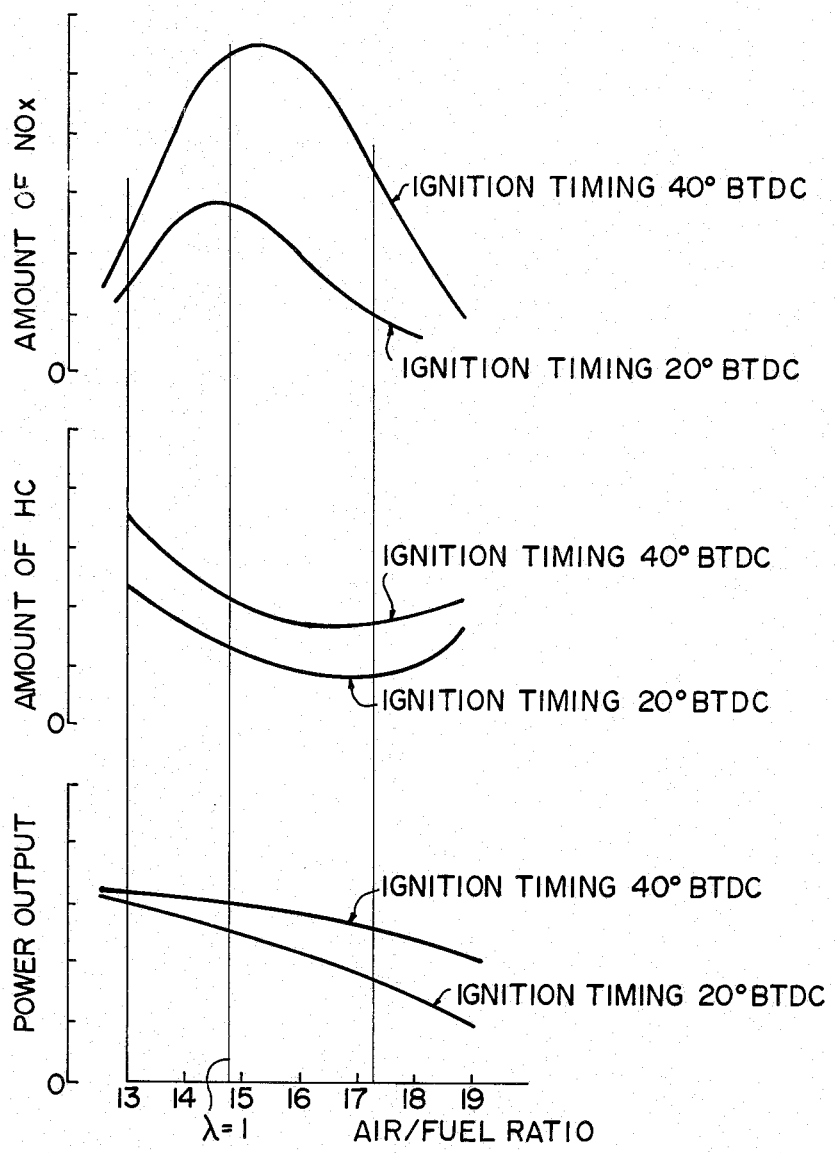
FIG. 2 is a diagram showing various characteristics of an internal combustion engine in relation to air-to-fuel ratios.

With this system, however, as will be seen from the exhaust gas components ($NO_x$ and HC) and engine power output versus air-to-fuel ratio characteristic curves shown in FIG. 2, the above-mentioned control point or the stoichiometric air-to-fuel ratio point (i.e., the point, $\lambda = 1$, where $\lambda$ designates an air number which is a measure of the composition of the air-fuel mixture. The air number $\lambda$ is proportional to the mass of air and fuel, and the value of this number $\lambda$ equals to 1 if a stoichiometric mixture is present) is in the vicinity of the point where the $NO_x$ content in the exhaust gases is at a maximum. Thus, no matter how excellent the purification percentages and controllability of the three-component catalyst are, there is a limit to the cleaning up of exhaust gases. In particular, considering deterioration of the catalyst while in service, it is difficult for this type of conventional system to maintain its ability to reduce the $NO_x$ content in exhaust gases considerably over a long period of time.

Under these circumstances, the inventors have noted the following facts. In the case of a four cylinder engine, if a rich mixture (the air-to-fuel ratio equals to 13 : 1) is fed to two of the four cylinders and the other two cylinders is fed with a lean mixture (the air-to-fuel ratio equals to 17.2 : 1), the total air-to-fuel ratio approximates the stoichiometric air-to-fuel ratio with the air number $\lambda = 1$. Consequently, if a three-component catalytic converter is used, the equivalent amounts of CO and $O_2$ just correspond to the required amounts and the maximum purification percentages result. Moreover, by selecting the firing order of the cylinders in such a manner that the cylinders fed with the rich mixture and those fed with the lean mixture are fired in alternate order, the resulting amount of $NO_x$ emission will be the sum of those resulting from the rich and lean mixtures, reducing the absolute quantity of $NO_x$ produced. Namely, the emissions of all of the three components $NO_x$, CO and HC are reduced considerably. On the other hand, since the power output of the engine simply decreases with the air-to-fuel ratio, even if the cylinders fed with the rich mixture and those fed with the lean mixture are fired in the alternate order, the resulting power output practically corresponds to that obtainable with a mixture having the stoichiometric air-to-fuel ratio or the intermediate air-to-fuel ratio.

For reference, the above-mentioned total air-to-fuel ratio is calculated in the following manner.

If $\alpha T$ represents the total air-to-fuel ratio of two air-to-fuel ratios $\alpha_1$ and $\alpha_2$, then $\alpha T$ is calculated as follows. That is, from the equations, $\alpha_1 = A_1/F_1$ and $\alpha_2 = A_2/F_2$ (where $A_1$ and $A_2$ are air quantities and $F_1$ and $F_2$ are fuel quantities), we obtain $$\alpha_T = (A_1 + A_2)/(F_1 + F_2).$$

It is therefore an object of this invention to provide an internal combustion engine which is capable of not only reducing the CO and HC contents in the exhaust gases but also greatly reducing the $NO_x$ emissions.

In accomplishing the above and other equally desirable objects, the improved internal combustion engine provided in accordance with the present invention comprises a plurality of sequentially operative combustion chambers, mixture feeding means for producing a rich mixture having an air-to-fuel ratio smaller than the stoichiometric air-to-fuel ratio and a lean mixture with an air-to-fuel ratio greater than the stoichiometric air-to-fuel ratio and for feeding the rich mixture to at least one of the combustion chambers and the lean mixture to the remaining combustion chambers, an exhaust system for gathering the exhaust gases emitted from the combustion chambers and discharging the exhaust gases into the air, air/fuel ratio detecting means disposed in the exhaust system for detecting the composition of the gathered exhaust gases and detecting the total air-to-fuel ratio of the rich and lean mixtures to generate an output signal, and control means responsive to the output signal of the air/fuel ratio detecting means for adjusting the air-to-fuel ratio of one of the rich and lean mixtures to maintain the total air-to-fuel ratio substantially at a predetermined value.

The engine of this invention has among its great advantages the fact that it is capable of maintaining the air-to-fuel ratio of the mixtures as a whole at the correct air-to-fuel ratio required by an exhaust emission control system such as a three-component catalyst or thermal reactor to thereby purify with excellent purification percentages and suppress CO, HC and $NO_x$ emissions, while the production of $NO_x$ itself due to the burning of fuel in the engine is suppressed to a low level, thereby greatly reducing harmful exhaust gas emissions.

Figure 3:
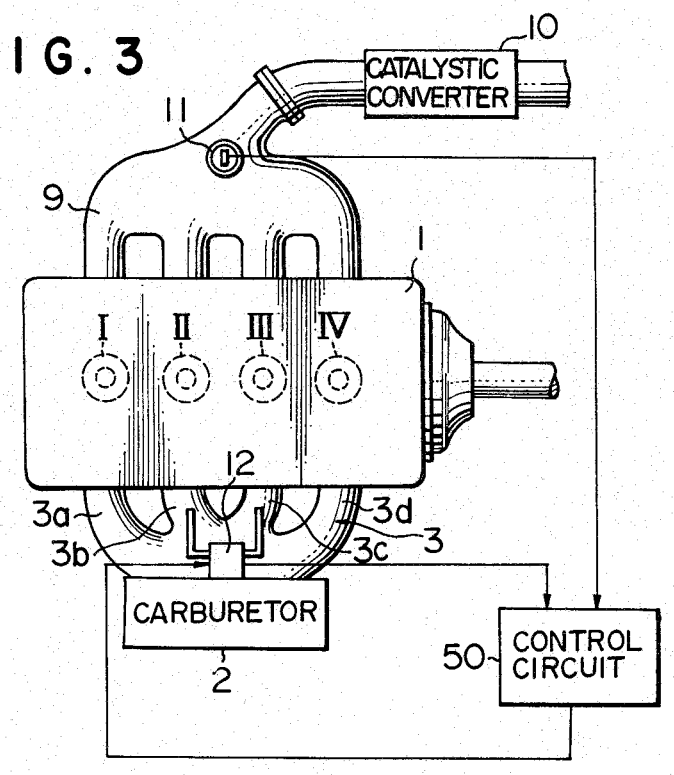
FIG. 3 is a schematic diagram showing a first embodiment of this invention.
Figure 4:
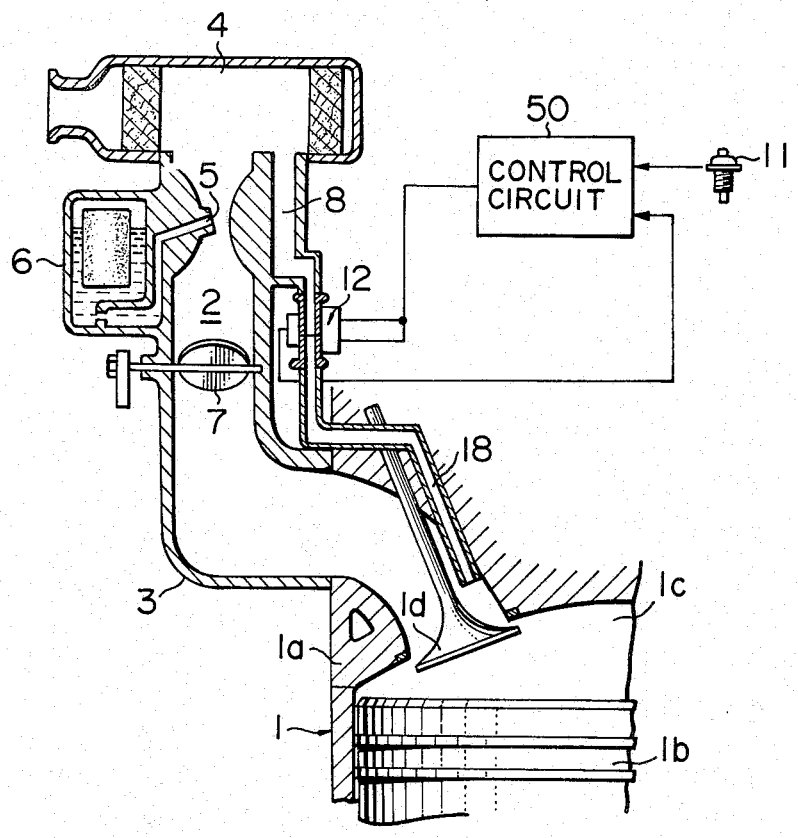
FIG. 4 is a sectional view of the cylinder in the embodiment of FIG. 3 which is fed with a lean mixture.

The present invention will now be described in greater detail with reference to the illustrated first embodiment. FIG. 3 illustrates a schematic diagram of the embodiment and FIG. 4 illustrates a schematic sectional view of the intake system used in the embodiment. In FIGS. 3 and 4 illustrating the first embodiment, numeral 1 designates an internal combustion engine which in this embodiment is an in-line four cylinder, reciprocating-type engine. Of course, this embodiment is applicable to any type of internal combustion engines and the invention is not intended to be limited to the reciprocating-type internal combustion engines. The engine 1 has a conventional ignition system which is not shown and the firing order of the engine 1 is the first cylinder I (the leftmost cylinder in FIG. 3) → third cylinder III → fourth cylinder IV → second cylinder II. The engine 1 has a cylinder block defining the cylinders therein and a cylinder head 1*a* (shown in FIG. 4). As will be seen from FIG. 4, each of the cylinders has a piston 1*b* which reciprocates within the cylinder and a combustion chamber 1*c* is defined by the cylinder block, the cylinder head 1*a* and the piston 1*b*. The cylinder head 1*a* includes an intake valve 1*d* for each cylinder which opens and closes an inlet port communicating with the combustion chamber 1*c*.

The engine 1 is fed with the air-fuel mixtures from a carburetor 2 through an intake manifold 3. As will be seen from FIG. 4, the carburetor 2 is of the conventional type in which clean air from an air filter 4 is mixed with fuel and atomized producing the required air-fuel mixture, and the carburetor 2 includes a fuel nozzle 5, a float chamber 6 and a throttle valve 7 which is linked to the accelerator pedal (not shown) through the link mechanism (not shown) for controlling the amount of air-fuel mixture.

As shown in FIG. 3, the air-fuel mixture prepared in the carburetor 2 is supplied to the first cylinder I, second cylinder II, third cylinder III and fourth cylinder IV of the engine 1 through branches 3*a*, 3*b*, 3*c* and 3*d* of the intake manifold 3. As shown in FIG. 4, a bypass duct 8 which bypasses the carburetor 2 is provided between the air filter 4 and the intake ports of the second and third cylinders II and III of the engine 1 so as to additionally supply clean air to the engine 1.

Figure 8:
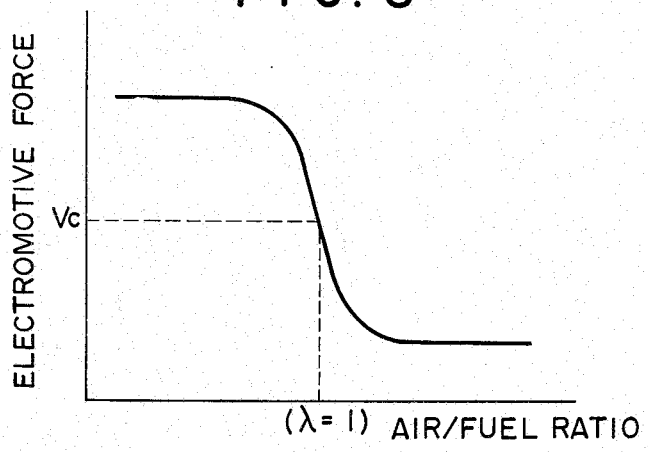
FIG. 8 is an output characteristic diagram of the air/fuel ratio sensor shown in FIG. 3.

The exhaust system of the engine 1 is provided, as shown in FIG. 3, with an exhaust manifold 9 into which the exhaust gases are discharged from the engine 1 and a three-component catalytic converter 10 located downstream of the exhaust manifold 9 for cleaning up the exhaust gases. An air/fuel ratio sensor 11 of a known type is mounted in the exhaust manifold 9 at the point where the exhaust gases from the cylinders gather. The air/fuel ratio sensor 11 is made from a solid electrolyte such as zirconium dioxide and the electromotive force of the sensor 11 varies, as shown in FIG. 8, in a step fashion in accordance with the concentration of oxygen in the exhaust gases, producing an electric signal. The electromotive force of the sensor 11 varies with the stoichiometric air-to-fuel ratio (when the fuel is gasoline) of mixtures fed to the engine 1 as a threshold. Naturally, the concentration in the exhaust gases is closely related with the air-to-fuel ratio of the mixture. Of course, the air/fuel ratio sensor 11 may also be of the type which detects the CO concentration in the exhaust gases or alternately it may be of a type employing titanium dioxide ($TiO_2$) so that its electric resistance value varies with the composition of exhaust gases. It is also possible to mount the air/fuel ratio sensor 11 in the exhaust pipe downstream of that portion where the exhaust gases from the first and fourth cylinders I and IV and those from the second and third cylinders II and III are gathered and mixed together.

Figure 5:
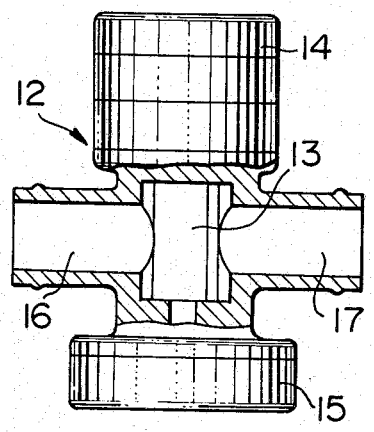
FIG. 5 is a partial sectional view of the air control unit shown in FIG. 4.

In FIG. 4, numeral 12 designates an air control unit inserted in the bypass duct 8 for adjusting the flow rate of additional air and it comprises, as shown on an enlarge scale in FIG. 5, a control valve 13 consisting of a rectangular butterfly valve, a pulse motor 14 mounted on the shaft of the valve 13 for driving it, a potentiometer 15 connected to the shaft of the control valve 13 to change its resistance value with the position of the control valve 13 and thereby to detect the position of the control valve 13 and air ducts 16 and 17 which are connected to the bypass duct 8.

As designated at 18 in FIG. 4, the lower portion of the bypass duct 8 is formed into air injection or induction nozzles which are disposed to respectively open to the intake ports of the second and third cylinders II and III of the engine 1 toward the respective combustion chambers 1*c*, thereby supplying an additional air to the intake ports by the intake manifold vacuum from the engine 1.

Of course, any other means such as an air pump may be mounted to supply an additional air under pressure, in which case the second and third cylinders II and III for which the mixture is leaned out will be supercharged making it possible to provide compensation for decrease in the torque and to easily balance the output of these cylinders with that of the first and fourth cylinders I and IV thereby proving effective against the engine vibrations, etc.

Numeral 50 designates a control circuit responsive to the output electric signal of the air/fuel ratio sensor 11 for operating the control valve 13 through the pulse motor 14 of the air control unit 12 and controlling the flow rate of additional air.

Figure 6:
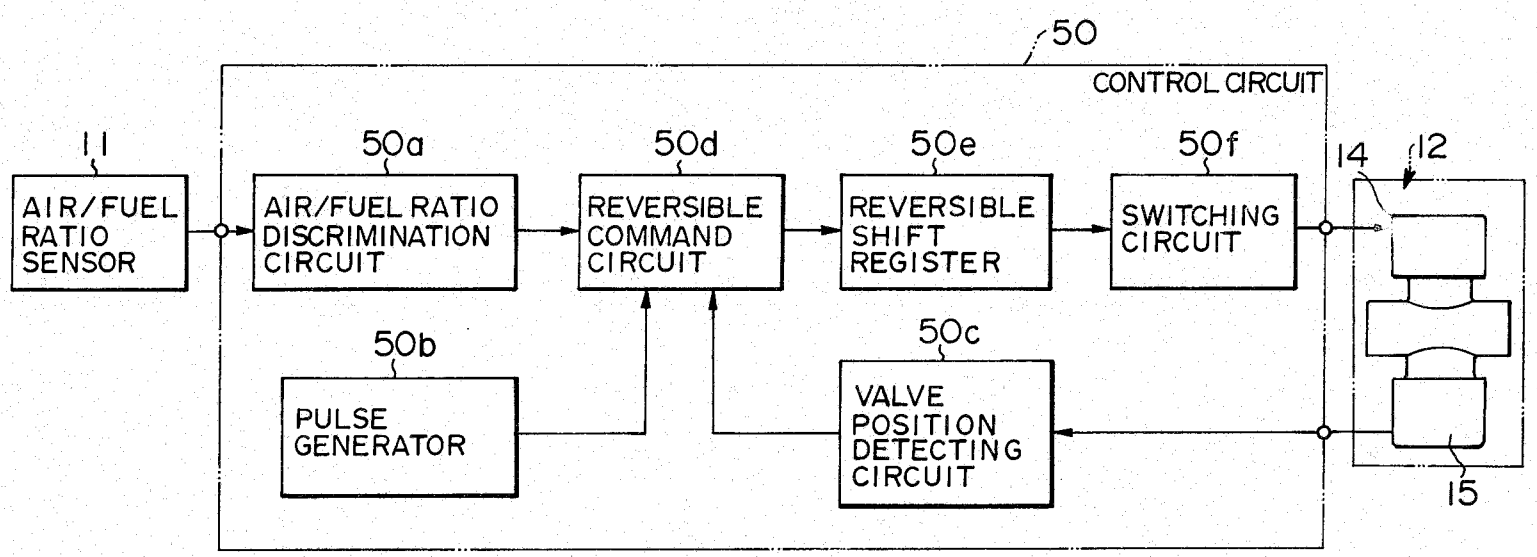
FIG. 6 is a block diagram of the control circuit shown in FIG. 4.
Figures 9A, 9B:
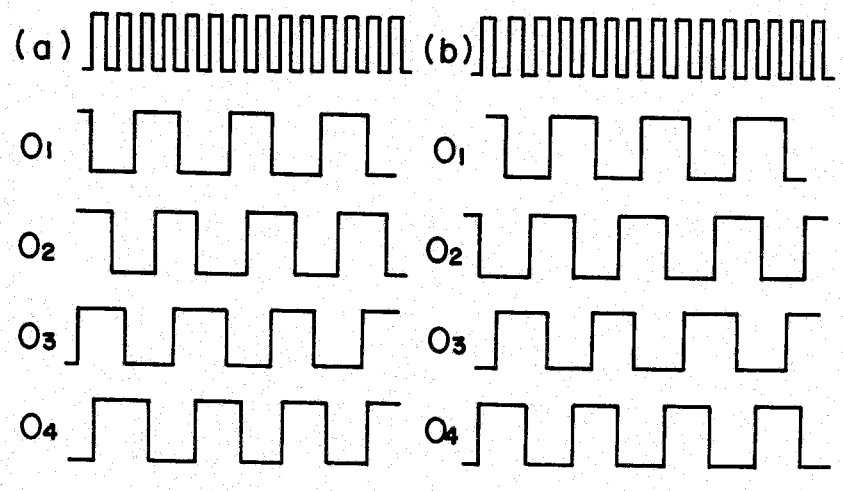
FIGS. 9A and 9B are waveform diagrams useful for explaining the operation of the reversible shift register shown in FIG. 7.

Next, the operation of the control circuit 50 will now be described with reference to the signal flow diagram of FIG. 6 and the detailed wiring diagram of FIG. 7. The output voltage of the air/fuel ratio sensor 11 is applied to an air/fuel ratio discrimination circuit 50*a* which determines in accordance with the composition of the exhaust gases whether the air-to-fuel ratio is small i.e., on the rich mixture side, or the air-to-fuel ratio is large i.e., on the lean mixture side. The discrimination circuit 50*a* comprises a voltage comparison circuit including resistors 51, 52 and 53 and a differential operational amplifier 54 (hereinafter simply referred to as an OP Amp.), whereby a set voltage preset by the resistors 52 and 53 is compared with the input voltage applied from the air/fuel ratio sensor 11 so that when the input voltage is higher than the set voltage, namely, when the air-to-fuel ratio is smaller than the stoichiometric air-to-fuel ratio or the mixture is rich, the logical output goes to a "1" level, whereas when the input voltage is lower than the set voltage or the mixture is lean, the logical output goes to a "0" level. The set voltage is preset so that it is equal to an output electromotive force $V_c$ which lies midway between the maximum and minimum outputs of the air/fuel ratio sensor 11. Numeral 50b designates a pulse generator comprising an astable multivibrator including NAND gates 55 and 57 and capacitors 56 and 58 and its output pulse frequency is selected to ensure the optimum control. On the other hand, voltage is applied across the ends of the potentiometer 15 which detects the position of the control valve 13, so that the movable contact of the potentiometer 15 is moved in response to the rotation of the control valve 13 varying the resistance value between the movable contact and the ground and this variation is converted into a voltage variation or an output signal which in turn is applied to a valve position detecting circuit 50c. The valve position detecting circuit 50c comprises a full-open position detecting circuit including resistors 60, 62 and 64, an OP Amp. 66 and a full-closed position detecting circuit including resistors 61, 63 and 65 and an OP Amp. 67. With such an arrangement, when the control voltage 13 is in the full-closed position only the output of the full-closed position detecting circuit goes to the "0" level, whereas when the control valve 13 is in the full-open position only the output of the full-open position detecting circuit goes to the "0" level. When the control valve 13 is in any other position the outputs of the two circuits go to the "1" level. The output signal of the air/fuel ratio discrimination circuit 50a, the output signal of the valve position detecting circuit 50c and the pulse signals from the pulse generator 50b are applied to a reversible command circuit 50d producing forward and reversing signals. The reversible command circuit 50d comprises logical elements or NOT gates 70, 73 and 74 and NAND gates 71, 72, 76 and 77, whereby when the air-to-fuel ratio is on the rich side the NAND gate 71 is opened passing the pulse signals from the pulse generator 50b to an input terminal (*a*) of a reversible shift register 50e, whereas when the total air-to-fuel ratio of the exhaust gas is on the lean side the NAND gate 72 is opened passing the pulse signals to an input terminal (*b*) of the reversible shift register 50e. The reversible shift register 50e is designed so that when the pulse signals are applied to the terminal (*a*), its output terminals $O_1$, $O_2$, $O_3$ and $O_4$ are sequentially shifted as shown in FIG. 9A, whereas when the pulse signals are applied to the terminal (*b*) the output terminals $O_4$, $O_3$, $O_2$ and $O_1$ are sequentially shifted as shown in FIG. 9B. The output terminals $O_1$, $O_2$, $O_3$ and $O_4$ are connected to a switching circuit 50f comprising resistors 80, 81, 82 and 83, transistors 84, 85, 86 and 87 and counter electromotive force absorbing diodes 88, 89, 90 and 91, and the switching circuit 50f is also connected to field coils $C_1$, $C_2$, $C_3$ and $C_4$ of the pulse motor 14.

Figure 7:
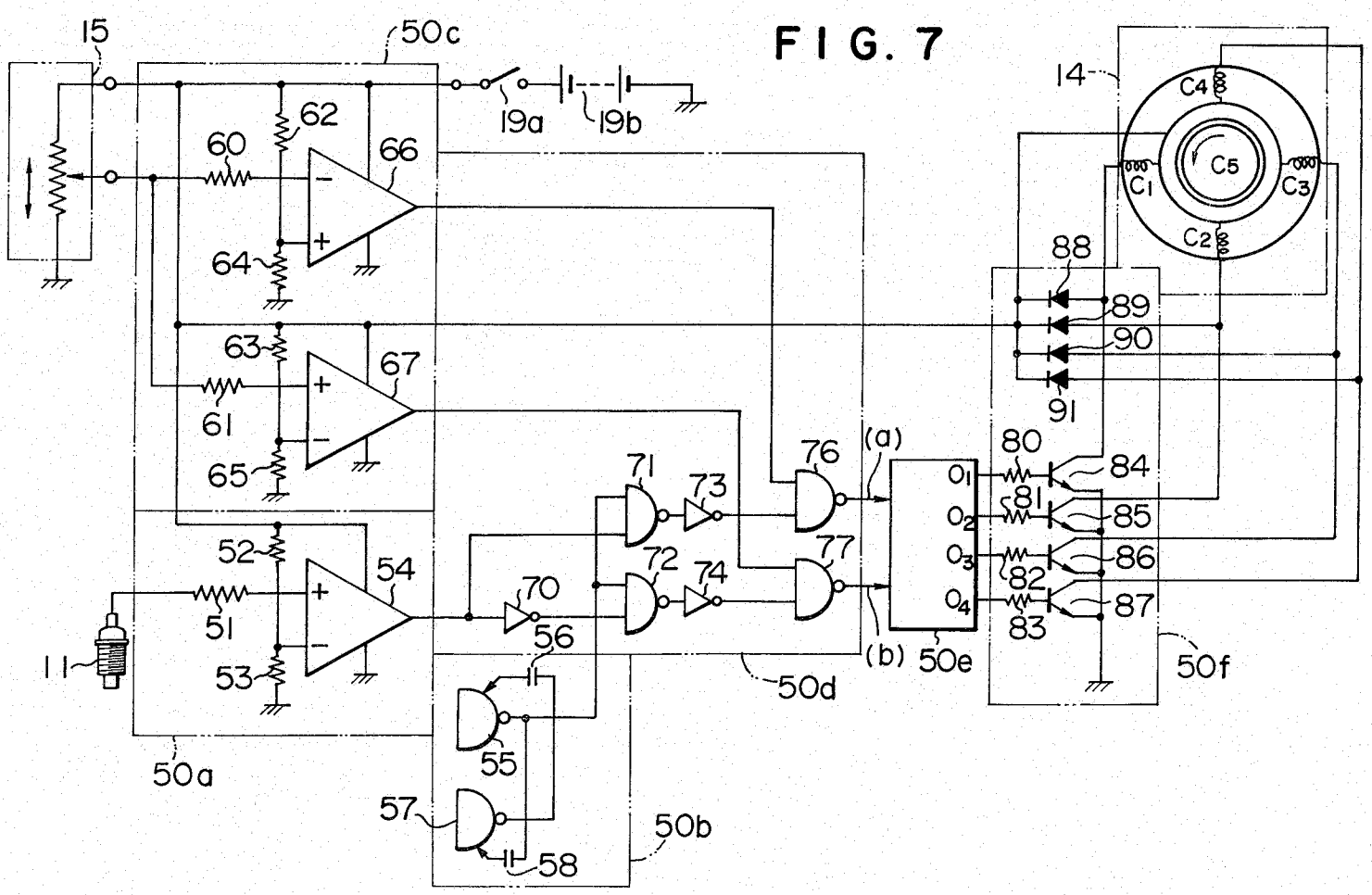
FIG. 7 is a circuit diagram of the control circuit shown in FIG. 4.

When the pulse signals are applied to the input terminal (*a*) of the reversible shift register 50e, the transistors 84, 85, 86 and 87 are sequentially turned on and the field coils $C_1$, $C_2$, $C_3$ and $C_4$ are similarly energized two phases at a time, causing a rotor $C_5$ of the pulse motor 14 to rotate in the direction of the arrow shown in FIG. 7. On the other hand, when the pulse signals are applied to the input terminal (*b*) of the reversible shift register 50e, the rotor $C_5$ of the pulse motor 14 is rotated in a direction opposite to the direction of the arrow.

The control circuit 50 is connected to and energized by a battery 19b constituting a DC power source through an ignition key switch 19a of the engine 1.

With the construction described above, the operation of the first embodiment is as follows. The carburetor 2 is adjusted so that the value of the air-to-fuel ratio of the rich mixture fed to the first and fourth cylinders I and IV is set to 13 : 1, for example, and this rich mixture is distributed to the respective cylinders of the engine 1, supplied into their respective combustion chambers 1c and discharged, after the completion of the burning, into the air through the exhaust manifold 9 and the catalytic converter 10. At the same time, the air/fuel ratio sensor 11 located in a portion of the exhaust gathering section of the exhaust manifold 9 detects the air-to-fuel ratio of the mixture and supplies the resulting air/fuel ratio signal to the control circuit 50, so that the pulse motor 14 or the drive motor of the air control unit 12 is operated in response to the output of the control circuit 50 varying the cross-sectional area of the passage by the control valve 13 and an additional air is supplied through the air injection nozzles 18 into the intake ports of the second and third cylinders II and III. The amount of this additional air is controlled in such a manner that the average air-to-fuel ratio of the mixture as a whole corresponds to the desired air-to-fuel ratio. Assuming now that this desired air-to-fuel ratio corresponds to the stoichiometric air-to-fuel ratio, the basic rich mixture is fed to the first and fourth cylinders I and IV and the mixture fed to the second and third cylinders II and III is leaned out by an additional air. Preferably, the air-to-fuel ratio of the basic rich mixture in the cylinders I and IV is 13 : 1 and the air-to-fuel ratio of the leaned out mixture in the cylinders II and III is 17.2. Consequently, as shown in FIG. 2, by virtue of the burning of the rich and lean mixtures, the $NO_x$ content in the exhaust gases is reduced considerably and moreover the fact that the total air-to-fuel ratio corresponds to the stoichiometric air-to-fuel ratio enables the three-component catalytic converter 10 to convert the three harmful compositions, i.e., HC, CO and $NO_x$ into harmless compositions with excellent purification percentages and discharge them into the air.

As is well known in the art, the air-to-fuel ratio of the mixture prepared in the carburetor 2 is not constant at all times and it varies frequently. When the mixture varies to the rich side, this results in a change in the composition of the exhaust gases from the engine 1 and particularly the oxygen content decreases. This change is detected by the air/fuel ratio sensor 11 located in the exhaust manifold 9. Consequently, when the total air-to-fuel ratio of the mixture as a whole, as detected in the exhaust system, is on the rich side as compared with the stoichiometric air-to-fuel ratio, the control valve 13 is rotated so as to increase the area of the opening between the air ducts 16 and 17 shown in FIG. 5, with the result that the amount of additional air supplied into the intake ports of the second and third cylinders II and III is increased thereby controlling the total air-to-fuel ratio of the mixture as a whole to approach the stoichiometric air-to-fuel ratio. On the other hand, when the air-to-fuel ratio is lean as compared with the stoichiometric air-to-fuel ratio, pulse signals are applied to the input terminal (*b*) of the reversible shift register 50e so that the rotor $C_5$ of the pulse motor 14 is rotated in a direction opposite to the direction of the arrow shown in FIG. 7 and the control valve 13 is rotated in a direction which reduces the area of the opening between the ducts 16 and 17. Consequently, the amount of additional air supplied to the intake ports of the second and third cylinders II and III is reduced thereby controlling the total air-to-fuel ratio of the mixture as a whole to approach the stoichiometric air-to-fuel ratio.

On the other hand, there is possibility that with the control valve 13 in operation the air-to-fuel ratio fails to attain the desired set air-to-fuel ratio when the control valve 13 is moved to either the full-closed position or the full-open position and consequently the air/fuel ratio discrimination circuit 50*a* continuously generates its output signal continuously rotating the control valve 13 into the "overshoot" condition. To prevent this, when the potentiometer 15 detects for example the full-closed position of the control valve 13, the valve position detecting circuit 50*c* closes the NAND gate 77 and thus the application of the pulse signals to the reversible shift register 50*e* is stopped, preventing the rotation of the pulse motor 14 in a direction which closes the control valve 13. On the contrary, when the control valve 13 is in the full-open position, the valve position detecting circuit 50*c* closes the NAND gate 76 and thus the application of the pulse signals to the reversible shift register 50*e* is stopped, preventing the rotation of the pulse motor 14 in a direction which opens the control valve 13. In this way, the normal operation is prevented from becoming inoperative by any "overshooting" of the control valve 13.

With this embodiment, where a two-carburetor, two-intake system method is employed so that the intake system is divided into two, one for the rich mixture cylinders and the other for the lean mixture cylinders, and the total air-to-fuel ratio of the mixture as a whole is corrected by means of an additional air, the control is accomplished in the intake system for the lean cylinders, whereas if the air-to-fuel ratio is corrected in the fuel supply system by for example varying the diameter of the main jet, the air-to-fuel ratio of the rich mixture is controlled. In any case, by supplying the rich and lean mixtures in the similar manner as mentioned in connection with the above-described embodiment, it is possible to control the total air-to-fuel ratio of the mixture as a whole to the desired air-to-fuel ratio.

Figure 10:
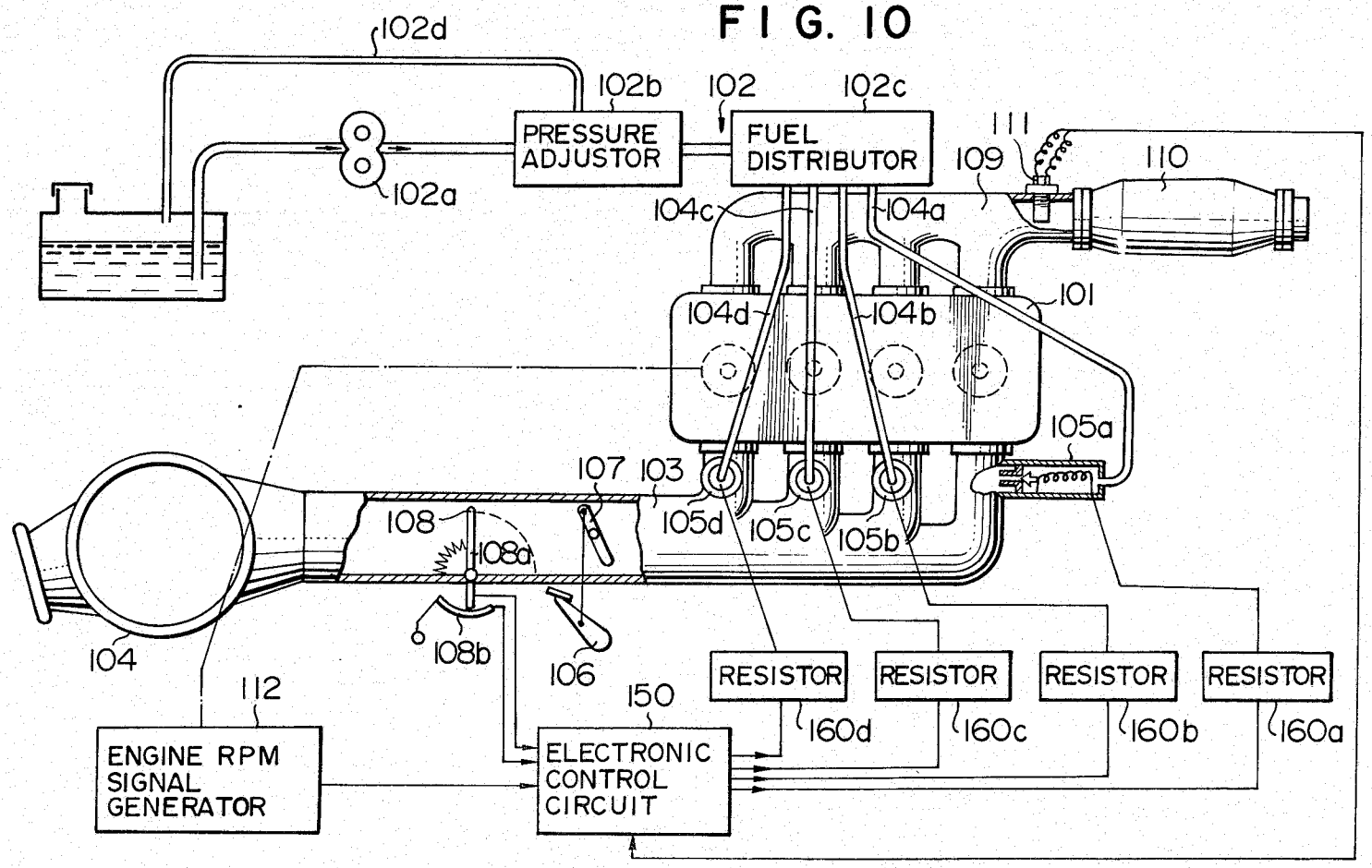
FIG. 10 is an overall schematic diagram showing a second embodiment of this invention.

A second embodiment of this invention will now be described. In this second embodiment, the carburetor is replaced with a fuel injection system and feedback control is effected on the amount of fuel fed for preparing mixtures. In FIG. 10 illustrating the second embodiment, numeral 101 designates a four cylinder, four cycle internal combustion engine whose firing order is the same as in the first embodiment, i.e., I-III-IV-II. Numeral 102 designates a known type of fuel deliverly system, 102*a* a motor-driven type fuel pump for feeding fuel under pressure, 102*b* a pressure regulator for maintaining the fuel pressure at a constant value, 102*c* a fuel distributor for distributing fuel to each cylinder, 102*d* a by-pass pipe for returning the excess fuel to the fuel tank.

An intake duct 103 supplies to the internal combustion engine 101 the clean air filtered by an air filter 104 and known type of electromagnetically operable injectors 105*a*, 105*b*, 105*c* and 105*d* are positioned on the branch ducts of the intake duct 103. The injectors 105*a*, 105*b*, 105*c* and 105*d* are respectively connected through fuel lines 104*a*, 104*b*, 104*c* and 104*d* to the fuel distributor 102*c* of the fuel delivery system 102. In the intake duct 103 is mounted a throttle valve 107 which controls the amount of intake air drawn into the engine 101 and this throttle valve 107 is operatively associated through a known type of link mechanism with an accelerator pedal 106 which is operated as desired.

An intake air amount detector 108 is of a known type which detects the amount of intake air and it comprises a flap 108*a* positioned upstream of the throttle valve 107 and a potentiometer 108*b* whose resistance value is varied in accordance with the rotation of the flap 108*a*, thereby producing an electric signal corresponding to the amount of intake air.

The exhaust gases from the engine 101 are discharged into an exhaust manifold 109 and released into the air through a three-component catalytic converter 110 and a muffler which is not shown. An air/fuel ratio sensor 111 is mounted in the exhaust manifold 109 at the point where the exhaust gases gather or in the exhaust pipe downstream of that point in the exhaust manifold 109.

Figure 11:
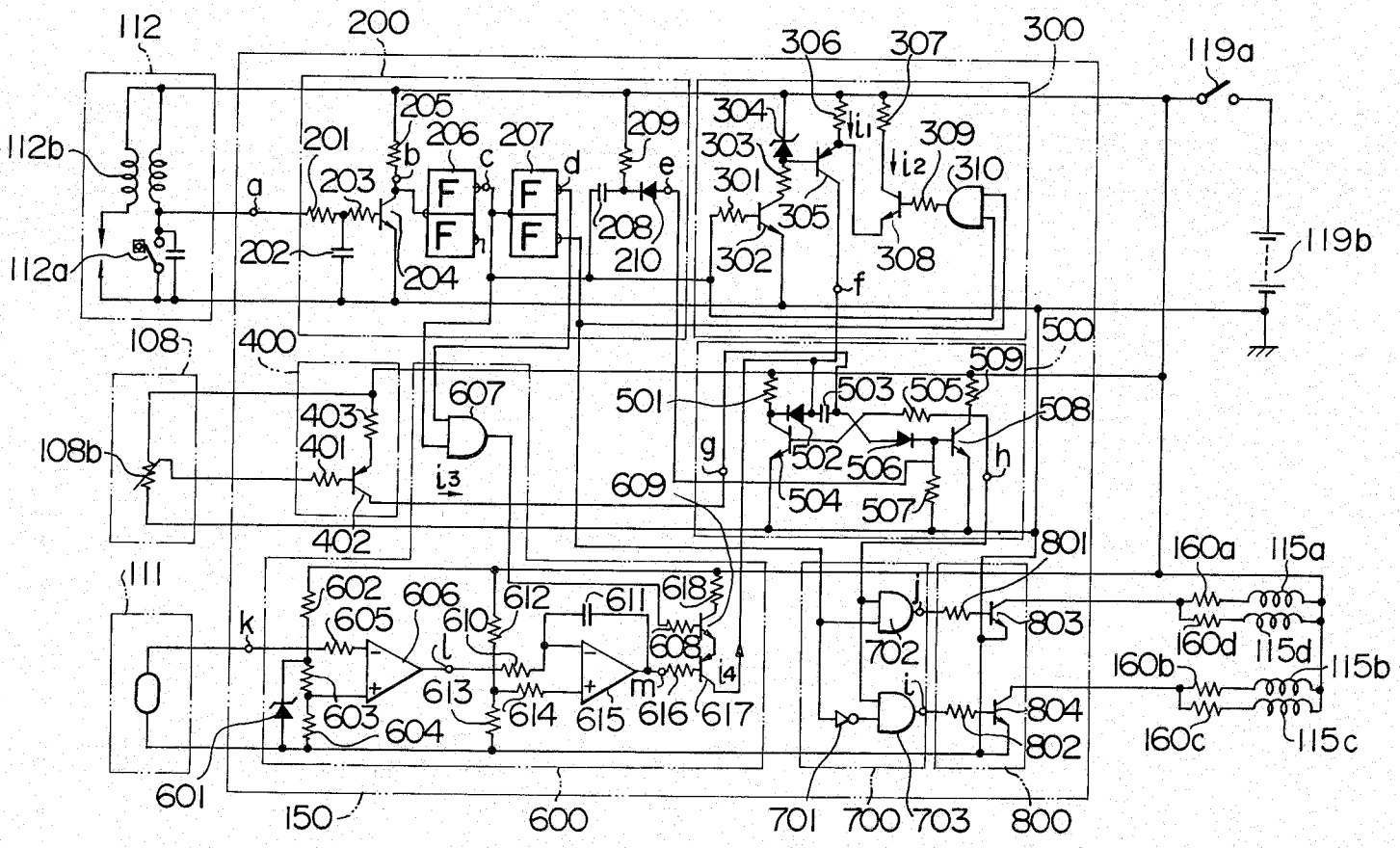
FIG. 11 is a circuit diagram showing the detailed construction of the electronic control circuit shown in FIG. 10.

Numeral 112 is an engine rpm signal generator which generates an electric signal corresponding to the speed of the engine 101 and as shown in FIG. 11 the signal generator 112 utilizes as its signal source the primary voltage of an ignition coil 112*b* which varies in accordance with the opening and closing of contacts 112*a* in the ignition system of the engine 101, thus producing four pulses for every two revolutions of the crankshaft of the engine 101. Numeral 150 designates an electronic control circuit for controlling the quantity of fuel delivered, which receives the electric signals generated from the intake air amount detector 108, the engine rpm signal generator 112 and the air/fuel ratio sensor 111, computes the required fuel injection quantity from these electric signals and applies its output fuel injection signals to the injectors 105*a*, 105*b*, 105*c* and 105*d* through resistors 160*a*, 160*b*, 160*c* and 160*d* provided for limiting current. The electronic control circuit 150 controls the fuel injection quantity by means of two separate control sections which correspond respectively to the rich and lean mixtures, namely, the fuel injection quantity is so controlled that basically the rich mixture is fed to the first and fourth cylinders of the engine 101 and the lean mixture is fed to the remaining second and third cylinders.

Referring now to FIG. 11 illustrating a detailed circuit construction of the electronic control circuit 150, numeral 200 designates a reference signal generating circuit comprising a waveform shaping circuit including resistors 201, 203 and 205, a capacitor 202 and a transistor 204, first and second flip-flops 206 and 207 which are responsive to the falling edges of the reshaped signals from the waveform reshaping circuit for dividing their frequency and a differentiation circuit including a resistor 209, a capacitor 208 and a diode 210 for differentiating the output signal of the first flip-flop 206, whereby the engine rpm signal generated from the engine rpm signal generator 112 is reshaped, frequency divided and differentiated producing various reference signals.

Numeral 300 designates a charging circuit comprising resistors 301, 303, 306, 307 and 309, a Zener diode 304, transistors 302, 305 and 308 and an AND gate 310, whereby a first charging current for computing the required fuel injection quantity for providing the rich mixture is determined by a sum $(i_1 + i_2)$ of a constant current $i_1$ determined by the resistor 306 and the Zener diode 304 and another constant current $i_2$ determined by the resistor 307 and the Zener diode 304, while a second charging current for computing the required fuel injection quantity for providing the lean mixture is determined by a sum ($i_1 + i_4$) of the constant current $i_1$ and an output current $i_4$ of an air/fuel ratio correction circuit 600.

Numeral 400 designates a discharging circuit comprising resistors 401 and 403 and a transistor 402, whereby the collector current of the transistor 402 increases as the output voltage of the intake air amount detector 108 decreases (i.e., as the amount of intake air decreases). The air/fuel ratio correction circuit 600 comprises a comparison circuit including resistors 602, 603, 604 and 605, a Zener diode 601 and an OP Amp. 606, an integrating circuit including resistors 612, 613, 610 and 614, a capacitor 611 and an OP Amp. 615, and a voltage-current conversion circuit including an AND aate 607, resistors 608, 616 and 618 and transistors 609 and 617, whereby when the transistor 609 is turned on indicating that the output of the air/fuel ratio sensor 111 became high and the air-to-fuel ratio of the mixture deviated in a direction which made it smaller than the stoichiometric air-to-fuel ratio, the output of the OP Amp. 606 goes to the "0" level and the output voltage of the integrating circuit gradually increases thus decreasing the output current $i_4$. Numeral 500 designates a main computing circuit including a monostable circuit composed of resistors 501, 505, 507 and 509, a capacitor 503, diodes 502 and 506 and transistors 504 and 508, and the collectors of the transistors 305 and 617 are connected to one end of the capacitor 503 and the collector of the transistor 402 is connected to the other end of the capacitor 503, whereby two kinds of injection pulse signals are alternately generated. Numeral 700 designates a distribution circuit comprising AND gates 702 and 703 and a NOT gate 701, whereby distributing the fuel injection pulse signals in alternate order. Numeral 800 designates an amplifier circuit comprising transistors 803 and 804 and resistors 801 and 802 for amplifying the injection pulse signals distributed from the distribution circuit 700, and the amplifier circuit 800 is connected to a DC power source **119*b* through the current limiting resistors 160*a*, 160*d*, 160*b* and 160*c*, energizing coils 115*a*, 115*d*, 115*b* and 115*c* of the injectors 105*a*, 105*d*, 105*b* and 105*c* and an ignition key switch 119*a***.

Figure 12:
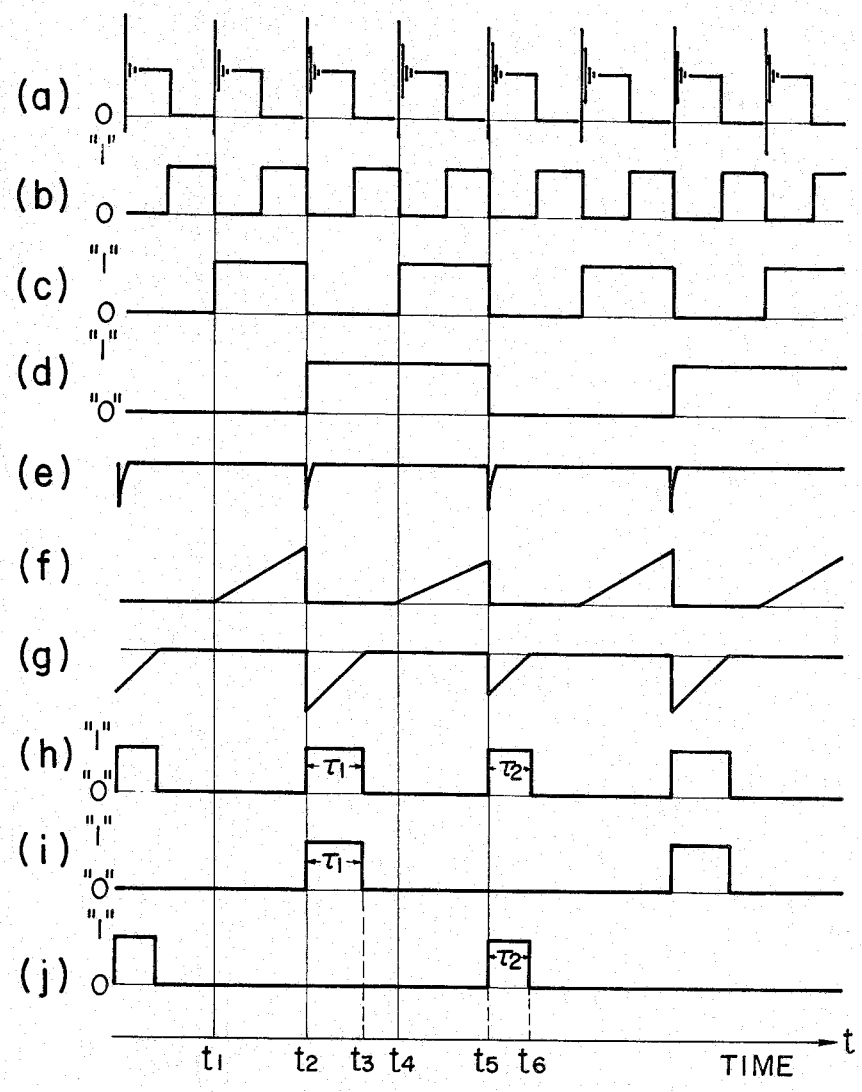
FIG. 12 is a waveform diagram useful for explaining the operation of the device of this invention.
Figure 13:
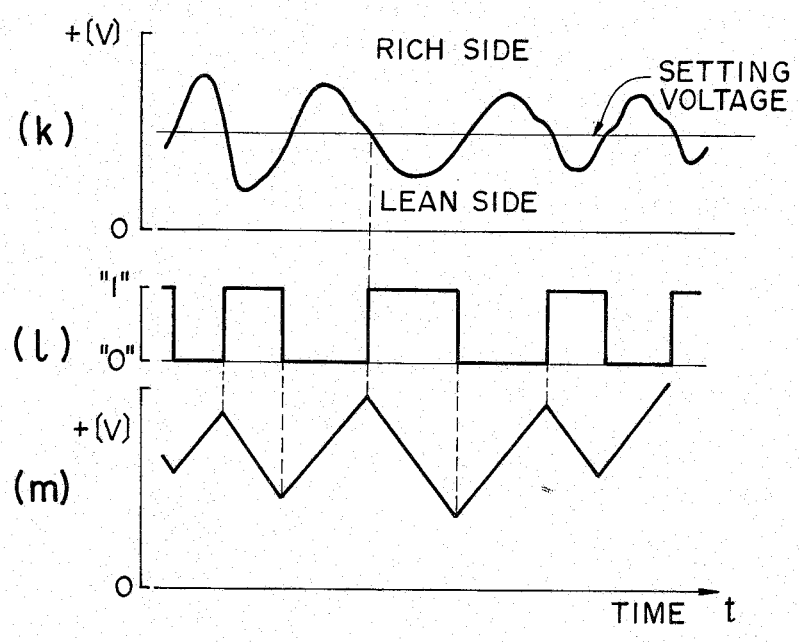
FIG. 13 is a waveform diagram useful for explaining the operation of the air/fuel ratio correction circuit.

With the construction described above, the operation of the second embodiment will now be described with reference to the waveform diagrams of FIGS. 12 and 13. The reference signal generator 200 receives the engine rpm signal generated at a terminal *a* from the engine rpm signal generator 112 and shown in (*a*) of FIG. 12 and generates at a terminal *b* the rectangular waveform synchronized with the engine rpm signal and shown in (*b*) of FIG. 12 as well as the frequency divided signals respectively shown in (*c*) and (*d*) of FIG. 12 at terminals *c* and *d*, respectively. The divided signal shown in (*c*) of FIG. 12 has a rectangular waveform whose period corresponds to one revolution of the crankshaft of the engine 101, and the divided signal shown in (*d*) of FIG. 12 has a rectangular waveform whose period corresponds to two crankshaft revolutions of the engine 101. Consequently, during time $t_1$ to $t_2$ when the divided signal shown in (*c*) of FIG. 12 is at the logical "1" level and the divided signal shown in (*d*) of FIG. 12 is at the logical "0" level, the transistors 302 and 308 of the charging circuit 300 are turned on so that the constant current ($i_1 + i_2$) flows to the collector of the transistor 305 and this constant current ($i_1 + i_2$) charges the capacitor 503 in the main computing circuit 500. Consequently, the potential at one terminal *f* of the capacitor 503 starts rising as shown in (*f*) of FIG. 12 at the moment that the potential at a terminal *c* goes from the "0" to "1" level at the time $t_1$. During this rise, the collector current $i_3$ of the transistor 402 which is dependent on the output voltage of the intake air amount detector 108 and the resistance value of the resistor 403, turns on the transistor 508 through the diode 506. When, at time $t_2$, the potential at the terminal *c* goes from the "1" to "0" level so that the charging of the capacitor 503 is terminated, a negative trigger pulse is generated as shown in (*e*) of FIG. 12 at an output terminal *e* of the differentiation circuit in the reference signal generating circuit 200 and the transistor 508 of the main computing circuit 500 is turned off causing an output terminal *h* of the main computing circuit 500 to go from the "0" to "1" level. This switching of the transistor 508 causes the base current to flow to the base of the other transistor 504 through the resistors 509 and 505, so that the transistor 504 is turned on and the potential at the terminal *f* of the capacitor 503 drops practically to the ground potential. Thus, after the time $t_2$, the charge stored in the capacitor 503 is discharged by the collector current $i_3$ of the transistor 402 of the discharging circuit 400 which corresponds to the intake air amount. In other words, when the differentiation circuit of the reference signal generating circuit 200 generates a negative trigger pulse, the potential at a terminal *g* of the capacitor 503 drops to a negative potential by an amount corresponding to the capacitor voltage just before the generation of the negative trigger pulse, after which the potential at the terminal *g* is increased by the collector current $i_3$ of the transistor 402 of the discharging circuit 400 as shown in (*g*) of FIG. 12 and the potential eventually attains a predetermined level at time $t_3$ causing the transistor 508 to turn on. Consequently, during the time $t_2$ to $t_3$ when the transistor 508 is turned off, an injection signal "1" of a pulse width $\tau_1$ is generated at the output terminal *h* of the main computing circuit 500 as shown in (*h*) of FIG. 12. Here, the collector current $i_3$ of the transistor 402 decreases as the intake air amount increases or the output voltage of the intake air amount detector 108 increases, thus increasing the pulse width $\tau_1$. On the other hand, the charging time of the capacitor 503 decreases as the number of revolutions of the engine 101 increases, thus decreasing the voltage on the capacitor 503 and hence the pulse width $\tau_1$. Of course, the discharging time of the capacitor 503 is set in accordance with the fuel requirement of the engine 101 and the pulse width $\tau_1$ of the injection pulse signal is determined by the charging current ($i_1 + i_2$) and the discharging current $i_3$. Thus, the pulse width $\tau_1$ increases as the charging current increases.

Then, during time $t_4$ to $t_5$ when the signal shown in (*c*) of FIG. 12 is at the "1" level and the signal shown in (*d*) of FIG. 12 is at the "1" level, the constant current $i_2$ is cut off by the turning off of the transistor 308 of the charging circuit 300, but the collector current $i_4$ of the air/fuel ratio adjusting transistor 617 is added by the turning on of the transistor 609 of the air/fuel ratio correction circuit 600, thus supplying a charging current ($i_1 + i_4$). The discharging current during time $t_5$ to $t_6$ is still determined by the discharging current $i_3$. Consequently, the resulting injection pulse signal has a pulse width $\tau_2$ which is shorter than the pulse width $\tau_1$ of the injection pulse signal generated during the time $t_2$ to $t_3$.

The air/fuel ratio correction circuit 600 will now be described in greater detail. The air/fuel ratio sensor 111 exhibits a stepped electromotive force characteristic for the air-to-fuel ratios near the stoichiometric one, so that a high voltage of about 0.8 to 1 V is generated at its terminal *k* as shown in (*k*) of FIG. 13 when the detected air-to-fuel ratio is on the rich (smaller) side as compared with those in the vicinity of the stoichiometric one, whereas a low voltage of less than 0.2 V is generated at the terminal *k* when the detected air-to-fuel ratio is on the lean (greater) side as compared with the stoichiometric one. Consequently, when the detected air-to-fuel ratio is smaller than the stoichiometric one, an output signal at a terminal *l* of the OP Amp. 606 goes to the "0" level as shown in (*l*) of FIG. 13 and the potential at an output terminal *m* of the integrating circuit increases as shown in (*m*) of FIG. 13. Thus, the collector current $i_4$ of the transistor 617 is decreased, decreasing the charging current $(i_1 + i_4)$ and reducing the pulse width $\tau_2$ of the injection pulse signal thereby producing an action in a direction which increases the air-to-fuel ratio. On the contrary, when the mixture is lean and its air-to-fuel ratio is greater than those in the vicinity of the stoichiometric one, the output terminal *l* of the OP Amp. 606 goes to the "1" level and the integrated voltage at the output terminal *m* of the integrating circuit is decreased, thus increasing the collector current $i_4$ and increasing the pulse width $\tau_2$ of the injection pulse signal thereby producing an action in a direction which decreases the air-to-fuel ratio.

These injection pulse signals are then applied to the distribution circuit 700 producing at its output terminals *i* and *j* the output signals shown respectively in (*i*) and (*j*) of FIG. 12 and these output signals are respectively applied through the power transistors 803 and 804 of the amplifier circuit 800 to the injectors 105*a* and 105*d* for the first and fourth cylinders and the injectors 105*b* and 105*c* for the second and third cylinders.

Thus, for every revolution of the engine 101 the pulses width $\tau_1$ and $\tau_2$ are alternately computed and the resulting injection pulse signals are distributed alternately to the two cylinders at a time. Thus, if it is adjusted as mentioned previously so that the pulse width $\tau_1$ is used for the rich mixture cylinders and the pulse width $\tau_2$ is used for the lean mixture cylinders, the lean and rich mixtures are burned in alternate order with the result that the amount of $NO_x$ in the exhaust gases is reduced considerably as shown in FIG. 2 and moreover the total air-to-fuel ratio of the mixture as a whole approaches the stoichiometric air-to-fuel ratio thus enabling the three-component catalytic converter 110 to convert the harmful compositions, i.e., HC, CO and $NO_x$ into harmless substances with excellent purification percentages.

While, in this embodiment, the flip-flops 206 and 207 of the reference signal generating circuit 200 do not assume the same states each time the key switch 119*a* is closed and thus it is not fixed which of the two cylinder groups, the first and fourth cylinders and the second and third cylinders, receives the rich mixture and which of the cylinder groups receives the lean mixture, where this should advantageously be fixed from the standpoint of ignition timing control, etc., it can be accomplished easily by resetting the flip-flops 206 and 207 by some form of cylinder signals.

Further, while, in the above-described embodiment, the air-to-fuel ratio is corrected by varying the charging current in the computing section for computing the correct fuel injection quantity corresponding to the desired lean mixture, the similar results may be obtained by varying for example the discharging current of the main computing circuit 500 or alternately by varying the charging current in the computing section for computing the correct fuel injection quantity corresponding to the desired rich mixture.

Furthermore, while the corrective control is accomplished to bring the total air-to-fuel ratio close to the desired air-to-fuel ratio (the stoichiometric air-to-fuel ratio) and thereby to ensure an improved exhaust gas cleaning function of the three-component catalyst, it is of course possible to effect the correction of air-to-fuel ratio and control it to one which is slightly on the lean side as compared with the stoichiometric one thereby improving the exhaust gas cleaning function of a thermal reactor in cases where the thermal reactor is provided in the exhaust system. For example, in the case of the second embodiment wherein the air-to-fuel ratio is corrected in either direction by the air/fuel ratio sensor 111 and the air/fuel ratio correction circuit 600, the air-to-fuel ratio may be controlled to the desired air-to-fuel ratio on the lean side by inserting a delay circuit so as to delay the correction of the air-to-fuel ratio made by these circuits in a direction which increases it.

Still further, while the cylinders are divided into two equal groups which are respectively fed with the rich and lean mixtures, it is possible to use other arrangements such as one in which each of the cylinders is alternately fed with the rich and lean mixtures or another in which the supply of the rich and lean mixtures is controlled so that instead of supplying the rich and lean mixtures respectively to the two equal cylinder groups, the two mixtures are respectively supplied to the two unequally divided groups.

Still further, noting the fact that $NO_x$ emissions are in greater amount particularly under high-load operating conditions, it is possible to control so that the supply of both the rich and lean mixtures is effected only under high-load operating conditions so as to prevent increased $NO_x$ emissions, while the common ordinary air-to-fuel ratio is used under normal driving conditions.

Still further, while the various computational operations are effected analogically in the electronic control circuit 150, these operations may be accomplished digitally.

What we claim is:

1. An internal combustion engine comprising:

a plurality of sequentially operative combustion chambers;

an exhaust system for gathering exhaust gases emitted from said combustion chambers and discharging said exhaust gases into the atmosphere;

a catalyst disposed in said exhaust system for purifying harmful components contained in said exhaust gases;

mixture feeding means for producing a rich mixture with an air-to-fuel ratio smaller than a stoichiometric air-to-fuel ratio and a lean mixture with an air-to-fuel ratio greater than said stoichiometric air-to-fuel ratio and for feeding said rich mixture to at least one of said combustion chambers and said lean mixture to the remainder of said combustion chambers during at least a time when the temperature of said catalyst is above a value where said catalyst operates effectively;

air/fuel ratio detecting means disposed in said exhaust system for detecting the composition of said gathered exhaust gases as a whole and detecting the total air-to-fuel ratio of said rich and lean mixtures to generate an output signal; and control means responsive to the output signal of said air/fuel ratio detecting means for adjusting the air-to-fuel ratio of one of said rich and lean mixtures to maintain said total air-to-fuel rato at a predetermined air-to-fuel ratio.

2. An internal combustion engine according to claim 1, wherein said mixture feeding means includes at least one carburetor.

3. An internal combustion engine according to claim 1, wherein said mixture feeding means includes a fuel injection system, said fuel injection system including:

fuel feeding means for distributing and feeding fuel under a predetermined pressure;

a plurality of injectors connected to said fuel feeding means, each of said injectors disposed to feed said fuel to associated one of said combustion chambers;

means for detecting the amount of air drawn into said combustion chambers to generate an output signal; and means responsive to the output signal of said intake air amount detecting means for basically controlling the quantity of fuel injected from each of said injectors.

4. An internal combustion engine according to claim 1, wherein said catalyst is comprised by a three-component catalytic converter for reducing CO, HC and $NO_x$, and wherein said total air-to-fuel ratio is substantially maintained at said stoichiometric air-to-fuel ratio by said control means.

5. An internal combustion engine according to claim 1, wherein the air-to-fuel ratio of said rich mixture is substantially 13 : 1, and the air-to-fuel ratio of said lean mixture is substantially 17.2 : 1.

6. An internal combustion engine according to claim 1, wherein said combustion chambers are even, and wherein said rich mixture is supplied to half of said combustion chambers and said lean mixture is supplied to the other half of said combustion chambers.

7. An internal combustion engine according to claim 1, wherein said combustion chamber include first to fourth chambers arranged in line, and wherein said rich mixture is supplied to said first and fourth combustion chambers and said lean mixture is supplied to said second and third combustion chambers.

8. An internal combustion engine comprising:

a plurality of sequentially operative combustion chambers;

an exhaust system for gathering exhaust gases emitted from said combustion chambers and discharging said exhaust gases into the atmosphere;

a catalyst disposed in said exhaust system for purifying harmful components contained in said exhaust gases;

a carburetor for producing a rich mixture with an air-to-fuel ratio smaller than a stoichiometric air-to-fuel ratio;

intake duct means disposed at the downstream of said carburetor for supplying said rich mixture to each of said combustion chambers during at least a time when the temperature of said catalyst is above a value where said catalyst operates effectively;

air supply means for supplying an additional air into part of said intake duct means in such a manner that said rich mixture fed to at least one of said combustion chambers is leaned out to an air-to-fuel ratio greater than said stoiciometric air-to-fuel ratio;

air/fuel ratio detecting means disposed in said exhaust system for detecting the composition of said gathered exhaust gases as a whole and detecting the total air-to-fuel ratio of said rich and lean mixtures to generate an output signal; and control means responsive to the output signal of said air/fuel ratio detecting means for controlling the amount of said additional air and adjusting the air-to-fuel ratio of said lean mixture to maintain said total air-to-fuel ratio substantially at a predetermined air-to-fuel ratio.

9. An internal combustion engine according to claim 8, wherein said control means includes valve means for adjusting the flow rate of said additional air, a motor coupled to said valve means for operating said valve means, and an electric circuit responsive to the output signal of said air/fuel ratio detecting means for controlling the rotation and stoppage of said motor.

10. An internal combustion engine according to claim 9, wherein said control means further includes position detecting means for detecting a full-closed position of said valve means to generate an output signal, and a circuit responsive to the output signal of said position detecting means for stopping the operation of said motor when said valve means is in the full-closed position.

11. An internal combustion engine according to claim 9, wherein said control means further includes position detecting means for detecting a full-open position of said valve means to generate an output signal, and a circuit responsive to the output signal of said valve means to stop the operation of said motor when said valve means is in the full-open position.

12. An internal combustion engine comprising:

a plurality of sequentially operative combustion chambers;

an exhaust system for gathering exhaust gases emitted from said combustion chambers and discharging said exhaust gases into the atmosphere;

a catalyst disposed in said exhaust system for purifying harmful components contained in said exhaust gases;

fuel feeding means for distributing and supplying fuel under a predetermined pressure;

a plurality of injectors connected to said fuel feeding means, each of said injectors disposed to supply said fuel to associated one of said combustion chambers;

intake duct means for supplying air to said plurality of combustion chambers;

means disposed in said intake duct means for detecting the amount of air drawn into said combustion chambers through said intake duct means to generate an output signal;

fuel control means responsive to the output signal of said intake air amount detecting means during at least a time when the temperature of said catalyst is above a value where said catalyst operates effectively for basically controlling the quantity of fuel injected from each of said injectors, said fuel control means further controlling the quantity of fuel injected by two separate sections so that at least one of said combustion chambers is fed with a rich mixture whose air-to-fuel ratio is smaller than a stoichiometric air-to-fuel ratio and the remainder of said combustion chambers are fed with a lean mixture whose air-to-fuel ratio is greater than said stoichiometric air-to-fuel ratio;

air/fuel ratio detecting means disposed in said exhaust system for detecting the composition of said gathered exhaust gases as a whole and detecting the total air-to-fuel ratio of said rich and lean mixtures to generate an output signal; and a control circuit responsive to the output signal of said air/fuel ratio detecting means for adjusting the fuel injection quantity of one of said two sections of said fuel control means to maintain said total air-to-fuel ratio substantially at a predetermined air-to-fuel ratio.

13. A method of reducing harmful components in exhaust gases of an internal combustion engine having a plurality of sequentially operative combustion chambers, and a catalyst comprising the steps of:

feeding a rich mixture to at least one of said combustion chambers and a lean mixture to the remainder of said combustion chambers during at least a time when the temperature of said catalyst is above a value where said catalyst operates effectively;

detecting the total air-to-fuel ratio of said rich and lean mixtures from the composition of exhaust gases emitted from said combustion chambers;

controlling the air-to-fuel ratio of one of said rich and lean mixtures in accordance with said detected total air-to-fuel ratio in such a manner that said total air-to-fuel ratio approaches a predetermined air-to-fuel ratio; and introducing said exhaust gases into said catalyst for reducing the harmful components in said exhaust gases.

14. A method of reducing harmful components in exhaust gases of an internal combustion engine having a plurality of sequentially operative combustion chambers and a catalyst, comprising the steps of:

producing rich mixtures with an air-to-fuel ratio smaller than a stoichiometric air-to-fuel ratio during at least a time when the temperature of said catalyst is above a value where said catalyst operates effectively;

supplying an additional air to part of said rich mixtures to produce lean mixtures with an air-to-fuel ratio larger than said stoichiometric air-to-fuel ratio;

feeding the remainder of said rich mixtures to at least one of said combustion chambers and said lean mixtures to the remainder of said combustion chambers;

detecting the total air-to-fuel ratio of said rich and lean mixtures from the composition of exhaust gases emitted from said combustion chambers;

controlling the amount of said additional air in accordance with said detected total air-to-fuel ratio in such a manner that said total air-to-fuel ratio approaches a predetermined air-to-fuel ratio; and introducing said exhaust gases into said catalyst for reducing harmful components in said exhaust gases.

* * * * *